United States Patent [19]

Glickman

[11] Patent Number: 5,049,105

[45] Date of Patent: Sep. 17, 1991

[54] HUB CONNECTOR FOR TUBES IN TOY CONSTRUCTION SET

[75] Inventor: Joel I. Glickman, Huntingdon Valley, Pa.

[73] Assignee: Magic Mold Corporation, Hatfield, Pa.

[21] Appl. No.: 492,644

[22] Filed: Mar. 13, 1990

[51] Int. Cl.[5] ..... A63H 33/08; A63H 33/06

[52] U.S. Cl. ..... 446/126; 446/121; 446/107

[58] Field of Search ..... 446/126, 125, 124, 122, 446/121, 120, 119, 116, 111, 107, 85

[56] References Cited

U.S. PATENT DOCUMENTS

| | | | |
|---|---|---|---|
| 1,092,217 | 4/1914 | Hopkins | 446/102 |
| 1,851,159 | 3/1932 | Dodge | 434/278 |
| 3,176,428 | 4/1965 | Slingluff | 446/107 |
| 3,648,404 | 3/1972 | Ogsbury et al. | 446/127 |
| 3,694,954 | 10/1972 | Brumlik | 446/102 |
| 3,830,011 | 8/1974 | Ochrymowich | 446/107 X |
| 4,078,328 | 3/1978 | Rayment | 446/102 |
| 4,758,196 | 7/1988 | Wang | 446/126 X |

FOREIGN PATENT DOCUMENTS

| | | | |
|---|---|---|---|
| 1106657 | 3/1960 | Fed. Rep. of Germany | 446/126 |
| 1099392 | 9/1955 | France | 446/126 |
| 1183331 | 7/1959 | France | 446/125 |
| 74205 | 11/1960 | France | 446/126 |
| 2058590 | 4/1981 | United Kingdom | 446/126 |
| 2105599 | 3/1983 | United Kingdom | 446/119 |

*Primary Examiner*—Robert A. Hafer
*Assistant Examiner*—D. Neal Muir
*Attorney, Agent, or Firm*—Schweitzer Cornman & Gross

[57] ABSTRACT

An improved connector element is disclosed, for use in toy construction sets. The connector is of injection molded construction, using a minimum weight of plastic material and designed for high speed, high volume production as extremely low cost. The connector includes lugs arranged to be received within tubular structural elements, for example plastic straws. The lugs have a full-length, longitudinal slot recess defining opposed lug portions normally slightly larger at the outer and inner end extremities than the interior of the structural elements. The slot recess is wider in the center portions then at either end. An integral compression post extends between the opposed lug portions in the region of the wider portions of the slot recess, so that only the outer portions of the lugs deflect inwardly when inserted into a tubular structural element. The body of the connector is formed of a central tubular hub surrounded by a thin walled flange which mounts the lugs. A thin web connects the tubular hub and the flange. Because of its low cost, it is practical to use the devices in large numbers in construction toy sets.

16 Claims, 2 Drawing Sheets

HUB CONNECTOR FOR TUBES IN TOY CONSTRUCTION SET

BACKGROUND AND SUMMARY OF THE INVENTION

The present invention is directed to toy construction sets of the general type comprising a plurality of linear structural elements and multi-position connector hubs. The hubs and structural elements can be joined in a variety of configurations, to assemble a wide variety of structures. An original form of such construction toy utilized wooden dowel rods as the linear structural elements, and the connector hubs were formed of circular wooden blocks with a plurality of radially directed sockets for the reception of the dowel rods. The inherently high cost and considerable bulk of the component parts of such a construction set were notable disadvantages.

It has been proposed in the past to form the hub connector and structural elements of plastic materials, utilizing plastic tubes as the structural elements, with hub connectors of molded plastic material. Examples of such prior proposals are reflected in the Ogsbury et al. U.S. Pat. No. 3,648,404 and the Rayment U.S. Pat. No. 4,078,328. The present invention is directed to an improvement in the type of construction presented by the beforementioned Ogsbury et al. and Rayment patents.

One of the objectives of the present invention is to provide a novel and improved molded plastic hub connector element, which is light in weight, utilizes a minimum amount of plastic material and is suitable for mass production at exceptionally low cost. The connector device of the invention is specifically designed for, although not necessarily limited to, utilizing widely available, common plastic straws, or the stock from which such straws are manufactured, as the tubular structural elements of the construction toy. The arrangement is such that large numbers of connectors may be made available at extremely low cost, enabling large and complicated constructions to be fabricated with a low cost toy set incorporating the device of the invention. By utilizing plastic straws or similar tubular plastic stock for the structural elements, the elements may be easily cut to custom lengths with a pair of household scissors, so that construction projects are not inhibited in any way by the initial selection of linear structural elements.

Pursuant to the invention, an improved injection molded plastic connector element is provided, which includes a relatively large number of connecting lugs, disposed radially about a central axis. The individual lugs, of generally circular cross sectional configuration, for reception inside the end portion of a plastic tube, are formed with a longitudinally extending slot recess which, in effect, divides the lugs into opposed, spaced-apart complimentary lug portions. The outer portion of each lug is somewhat enlarged in its effective diameter, to a size greater than the internal diameter of the tubular elements. When the tubular elements are applied over the lug, the outer portions thereof are elastically deflected towards each other to provide a snug friction fit. The lugs are slightly tapered, and the base portion of the lugs are also of a diameter slightly greater than that of the tubular element such that, when the tubular element is fully inserted over the lug, it is snugly received over the base portion, as well as the elastically deflected outer end portion.

To advantage, a thin compression post is interposed between the two spaced-apart lug portions, midway between the ends of the lug. This enables the lugs to be of relatively substantial length in relation to diameter, while at the same time minimizing plastic usage requirements by permitting a relatively thin cross section in the complimentary pairs of lug portions.

An advantageous form of the new connector hub incorporates a central cylindrical hub, adapted to receive a tubular structural element. A thin-walled web extends outwardly from the cylindrical hub and joins with a hub flange. Advantageously, the hub flange is of polygon form, with flat sides equal to the number of lugs.

For a more complete understanding of the above and other features and advantages of the invention, reference should be made to the following detailed description of a preferred embodiment and to the drawings.

DESCRIPTION OF A PREFERRED EMBODIMENT OF THE INVENTION

Figure 1:
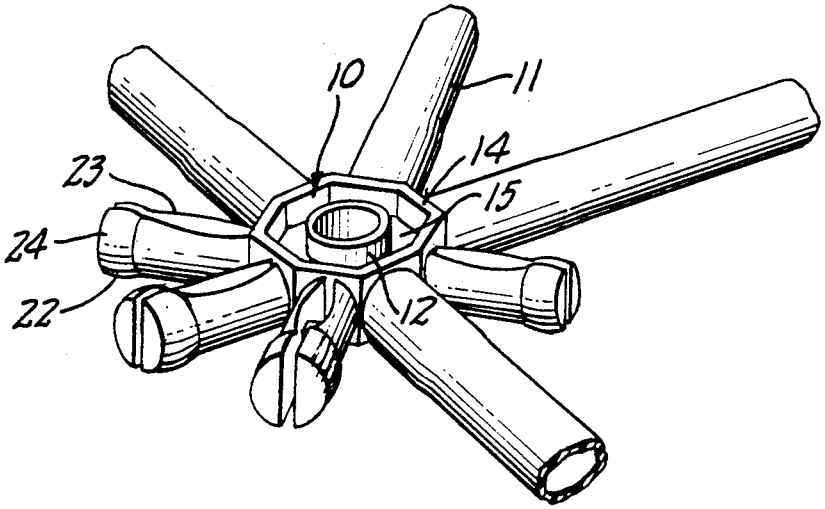
FIG. 1 is a perspective view of the improved connector element of the invention, shown with several tubular structural elements connected therewith.
Figure 2:
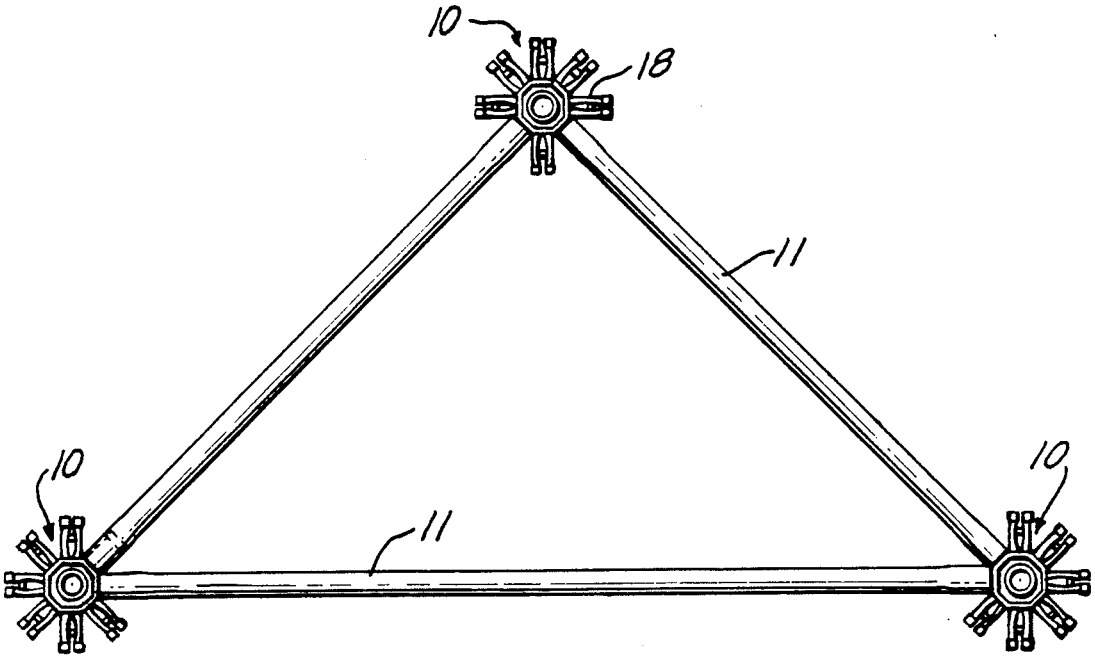
FIG. 2 is a representative elevational view of a simple structure utilizing the connector element of the invention.
Figure 3:
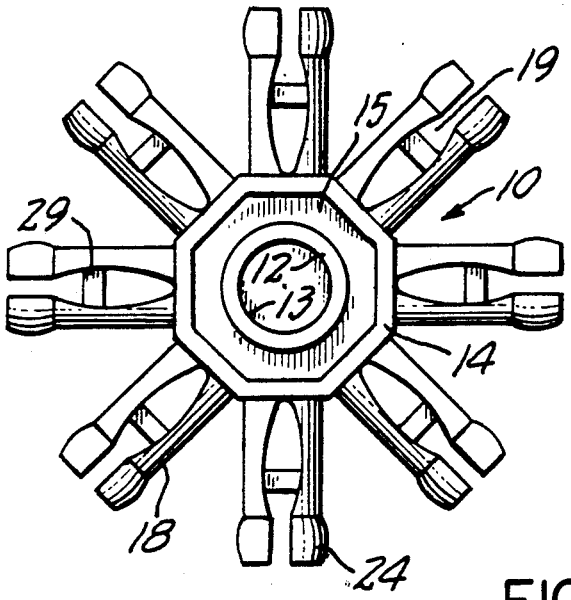
FIG. 3 is a top plan view of the improved hub connector element of the invention.
Figure 4:
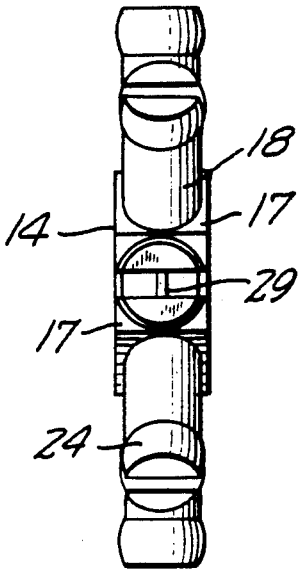
FIG. 4 is an end elevation of the connector of FIG. 3.
Figure 5:
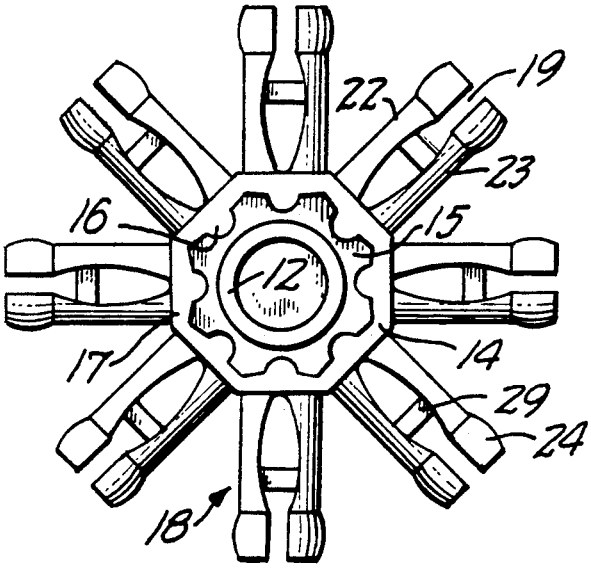
FIG. 5 is a bottom plan view of the connector of FIG. 3.
Figure 6:
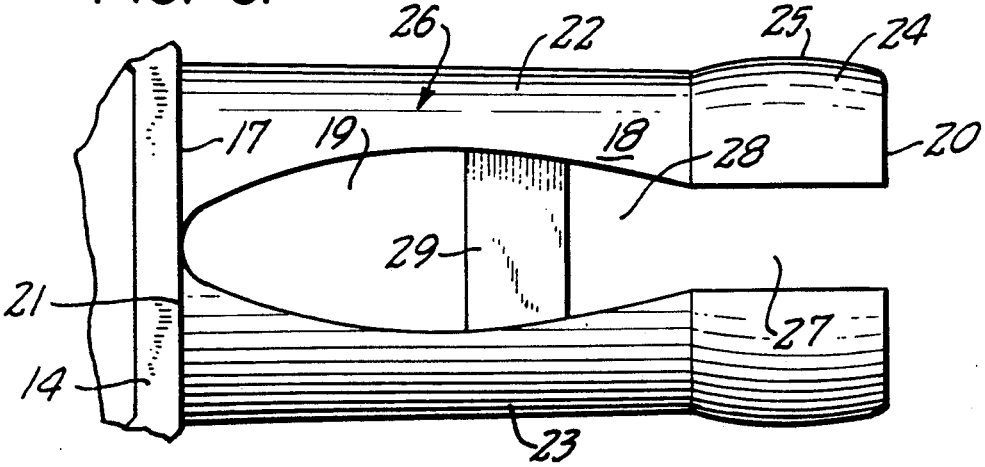
FIG. 6 is an enlarged, fragmentary illustration showing details of a connecting lug element of the connector of FIG. 3.

Referring now to the drawing, the reference numeral 10 designates generally a new connector element constructed according to the principles of the invention and employed for connecting one or more tubular structural elements 11. Although the invention is not necessarily limited thereto, it is contemplated that the tubular structural elements 11 may be of thin-walled plastic tubing, for example of the type commonly used for plastic drinking straws, for example. Indeed the straws themselves may be utilized as structural elements. Tubular elements of this type are light, strong and relatively uniform, with a typical inside diameter of about 0.222–0.226 inch, formed of a material such as polypropylene. The tubular elements 11, which form linear structural elements in constructions utilizing the elements of the invention, may also be cut to any length. Because of the relatively thin-walled construction of the elements, cutting to custom length by the user, with a pair of household scissors, is feasible and convenient.

In the form of the invention illustrated herein, the connector element 10 is a unitary, injection molded element, formed of a suitable moldable structural plastic, such as polypropylene. A central hub 12 is provided in the form of a short, thin-walled cylinder. The diameter of the inside wall 13 of the hub cylinder is such as to closely receive one of the tubular elements 11, with a minimum snugness permitting rotation and/or sliding movement, as may be desired. In a typical example, the inside wall diameter may be on the order of 0.250 inch for cooperation with a tubular element 11 also of nominal 0.250 outside diameter. In the illustrated device, the hub cylinder 12 may have an overall length of approximately 0.250 inch, and a typical wall thickness of 0.030 inch. It should be understood, of course, that specific dimensions given herein are merely representative of those utilized in the manufacture of one commercially advantageous form of the invention, and are not to be regarded as limiting.

Surrounding the hub cylinder 12, in generally concentric relation, is a flange wall 14, which advantageously is of polygonal form. In the illustrated version, the flange wall 14 is in the form of an octagon, suitably about 0.60 inch across, with a wall height of about 0.25 inch and wall thickness of about 0.50 inch.

The hub cylinder 12 and flange wall 14 are integrally joined by a flat, thin web 15. The web 15 may have a wall thickness consistent with the thickness of the hub cylinder 12 and flange wall 14, for example, 0.50 inch. Advantageously, the web 15 is centered axially with respect to both the hub cylinder and the flange wall. To facilitate the high speed, multi-cavity injection molding of the part, the flange wall 14 is provided on one side with pin pads 16, centered on the individual faces 17 of the octagonal flange wall and extending to the web 15. The pin pads facilitate high speed, automatic ejection of the parts from the mold cavity at the end of the molding operation.

Pursuant to the invention, each of the faces of the octagonal body, formed by the flange wall, web and hub cylinder, integrally mounts a radially extending mounting lug 18 of a size and shape to be received internally of the tubular structural elements 11. The individual lugs 18 are of generally circular cross sectional configuration and are provided with slot recesses 19 extending longitudinally therein from the outer end extremities 12 to or near the inner end extremities 21. The slot recesses extend entirely through the lugs 18, dividing the lugs into opposed, complimentary lug portions 22, 23 capable of being elastically deflected toward each other.

To advantage, the lugs 18 are of substantially greater length than diameter, so as to provide good support for a linear structural element received thereon. By way of example, a lug adapted to be received within a tubular element of 0.224 nominal inside diameter, may have a typical overall length of approximately 0.450, or about twice the diameter.

Pursuant to the invention, the outer end portion of each lug is provided with a somewhat bulbous portion 24 of enlarged diameter. For example, for reception in a tubular element of nominal inside diameter of 0.224 inch, the bulbous portion 24 may typically have a "normal" diameter of about 0.236 inch. The bulbous portion is arcuately contoured, so as to be somewhat convergent in its diameter for a short distance in either direction from the area 25 of maximum diameter. In the illustrated form of the invention, the bulbous portion 24 of the lug has a length of, for example, 0.125. The portion 26 of the lug, which extends from the bulbous portion 24 to the flange face 17, advantageously is slightly convergently tapered in a radially outward direction. For example, where the lug portion 26 joins with the bulbous portion 24, its nominal diameter may be approximately 0.216 inch. At the flange wall face 17, the diameter advantageously is as large as the maximum inside diameter of the tubular structural elements 11, considering the range of their tolerances, so that the end extremity of the tubular element is snugly received at the base end of the lug.

In the illustrated form of the invention, the slotted recess 19 is of substantial width, to minimize the amount of plastic material utilized in the lugs 18. In the region of the bulbous portion 24, the slot may have a width on the order of 0.062 inch. The outer portion 27 of the slot joins with an elliptically contoured inner portion 28, having a maximum width significantly greater (e.g., approximately two times) the width of the slot in the area of the bulbous extremity 24. In accordance with one aspect of the invention, an integral compression post 29 extends from one lug portion 22 to the other 23, approximately midway along the length of the lug, which is also in the region of the maximum width of the slotted recess 19. The compression post 29 can be of thin-walled construction, for example, about 0.062 inch in width and 0.020 inch in thickness. The compression post 29 serves substantially to prevent elastic inward deflection of the lug portions 22, 23, in the immediate region of the post, when the enlarged end portion 25 is inserted into the end of a tubular structural element. Inward deflection of the lug portions 22, 23 is limited to the cantilever portions radially outward of the compression post 29, providing a degree of resistance to the inward deflection which significantly exceeds the cantilever strength of the lug portions 22, 23 supported only at the face 17 of the flange wall.

The connector device of the invention is uniquely adapted for use in low cost construction toy sets. The design of the connector enables it to be most expeditiously manufactured on a mass production, injection molding production procedure, using a minimum of plastic material and enabling maximum output of units in relation to investment in machinery. At the same time, the unit has significant functional advantages in providing for easy assembly and reliable retention and support of the tubular construction elements.

Because of the extremely low cost of the unit, and its ability to be utilized with readily available tubular elements, such as plastic straws, the connector elements may be supplied in huge numbers, enabling toy construction projects of considerable scope and complexity to be undertaken with construction sets of exceptionally modest cost.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. For use in a toy construction set comprising a plurality of hub-like connector elements joining hollow tube-like linear structural elements, wherein said linear structural elements have an internal diameter substantially uniform throughout their length, an improved connector element which comprises (a) a one-piece injection molded unit including a body portion and a plurality of integral connecting lugs extending radially outward therefrom, (b) said connecting lugs being of generally circular cross-sectional configuration for close reception within an end portion of a tubular linear structural element, (c) each lug having a diameter and a length at least about two times said diameter, (d) each lug having inner and outer end extremities and having a slightly enlarged outer end portion, convergently configured at said outer end extremity to facilitate insertion in a tube-like structural member, (e) each lug having a longitudinally extending, open-ended slot recess therein extending from the outer end extremity thereof to a point closely adjacent its inner end, (f) said slot recess extending from one side to the other of said lug to define spaced-apart, complimentary lug portions and being of sufficient width of accommodate substantial elastic displacement of said lug portions toward each other, (g) a compression post extending between and integrally joining the spaced-apart portions of a lug at a position spaced inward from the enlarged outer end portion thereof, to increase the outward pressure of said lug portions within a tubular element applied thereover, (h) said enlarged outer end portions having a normal outside diameter slightly larger than the internal diameter of said tube-like structural elements.

2. An improved connector element according to claim 1, further characterized by, (a) said compression post having a cross sectional area which is a small fraction of the cross sectional area of the generally circular configuration of said a lug.

3. An improved connector element according to claim 1, further characterized by, (a) the configuration of a lug, in the regions radially inside the enlarged outer end portion thereof, being at least slightly convergently tapered in a radially outward direction, (b) the cross sectional configuration of a lug at its inner end extremity being such as to be snugly received within an end extremity of a tubular structural element.

4. An improved connector element according to claim 1, further characterized by, (a) said slot recess having a greater width in the region of said compression post than at the outer end extremity of said lug.

5. An improved connector element according to claim 1, further characterized by, (a) said body portion including a central, axially extending cylindrical hub portion, hub portion having an internal diameter to receive a tubular structural element.

6. An improved connector element according to claim 5, further characterized by, (a) the internal diameter of said hub portion being such, in relation to the tubular structural elements, as to have a relatively low-friction relationship with a structural element received therein.

7. For use in a toy construction set comprising a plurality of hub-like connector elements joining hollow tube-like linear structural elements, an improved connector element which comprises (a) a one-piece injection molded unit including a body portion and a plurality of integral connecting lugs extending radially outward therefrom, (b) said connecting lugs being of generally circular cross-sectional configuration for close reception within an end portion of a tubular linear structural element, (c) each lug having a diameter and a length at least about two times said diameter, (d) each lug having inner and outer end extremities and having a slightly enlarged outer end portion, convergently configured at said outer end extremities to facilitate insertion in a tube-like structural member, (e) each lug having a longitudinally extending, open-ended slot recess therein extending from the outer end extremity thereof to a point closely adjacent its inner end, (f) said slot recess extending from one side to the other of said lug to define spaced-apart, complimentary lug portions and being of sufficient width to accommodate substantial elastic displacement of said lug portions toward each other, (g) a compression post extending between and integrally joining the spaced-apart portions of a lug at a position spaced substantially from the opposite end extremities thereof, to increase the outward pressure of said lug portions upon a tubular element applied thereover, (h) said body portion including a central, axially extending cylindrical hub portion, (i) said hub portion having an internal diameter to receive a tubular structural element, (j) said hub portion having a length dimension and said body portion further including a thin, web-like portion extending radially from said hub portion, and (k) the thickness of said web-like portion being small in relation to the length dimension of said hub portion.

8. An improved connector element according to claim 7, further characterized by, (a) said body portion further including a thin-walled outer flange portion surrounding and integrally joined with said web-like portion and extending axially from said web-like portion, (b) said lugs being integrally joined to the exterior of said outer flange portion.

9. An improved connector element according to claim 8, further characterized by, (a) there being a predetermined plurality of lugs extending radially from said outer flange portion in uniform angular spacing, (b) said outer flange portion having the configuration of a polygon having a plurality of flat sides equal to the number of lugs.

10. An improved connector element according to claim 9, further characterized by, (a) said web-like portion being positioned midway between the axial ends of said hub portion and said flange portion.

11. A molded plastic hub-like connector for use in a construction toy set or the like for joining linear tubular structural elements, such as plastic straws, wherein the tubular structural elements have end extremities and an internal diameter substantially uniform through their length, which comprises (a) a plurality of molded connecting lugs of a cross sectional configuration for reception internally of said linear tubular structural elements for frictional retention therein and having a length substantially in excess of diameter, (b) said connecting lugs being formed with a longitudinally extending slot recess therein, extending from one side to the other thereof for substantially the full length of said lugs to define spaced-apart, complimentary lug portions and being of sufficient width to accommodate substantial elastic displacement of said lug portions toward each other, (c) outer extremities of said lugs being slightly enlarged to a diameter in excess of the internal diameter of said tubular structural elements, whereby the outer portions of opposed pairs of said lug portions are elastically displaced toward each other upon insertion of a lug into an end of a tubular structural member, (d) the portions of said lugs immediately inside of said enlarged outer extremities being of slightly lesser diameter than the internal diameter of said tubular structural elements, (f) said lug members having base end extremities of a diameter slightly greater than the internal diameter of said tubular structural elements, and being adapted to snugly receive an end extremity of tubular structural members applied over said lugs, (g) a central compression post integrally joining the lug portions supporting said lug portions in their flexion within tubular structural elements.

12. An improved connector element according to claim 11, further characterized by, (a) said slot recess being of greater width in its central portions than at the end of said lug members.

13. An improved connector element according to claim 11, further characterized by, (a) said integral compression post extending between said spaced-apart lug portions approximately midway along the length thereof, (b) said compression post having a cross sectional area constituting a small fraction of the circular cross sectional area of said tubular structural elements.

14. An improved connector element according to claim 13, further characterized by, (a) said slot recess having a greater width in the region of said compression post than at the outer end extremity of said lug member.

15. A molded plastic hub-like connector for use in a construction toy set or the like for joining linear tubular structural elements, such as plastic straws, wherein the tubular structural elements have a substantially uniform internal diameter and end extremities, which comprises (a) a plurality of molded connecting lugs of a cross sectional configuration for reception internally of said linear tubular structural elements for frictional retention therein and having a length substantially in excess of diameter, (b) said connecting lugs being formed with a longitudinally extending slot recess therein, extending from one side to the other thereof for substantially the full length of said lugs to define spaced-apart, complimentary lug portions and being of sufficient width to accommodate substantial elastic displacement of said lug portions toward each other, (c) outer extremities of said lugs being slightly enlarged to a diameter in excess of the internal diameter of said tubular structural elements, whereby opposed pairs of said lug portions are elastically displaced toward each other upon insertion of a lug into an end of a tubular structural member, (d) the portions of said lugs immediately inside of said enlarged outer extremities being of slightly lesser diameter than the internal diameter of said tubular structural elements, (f) said lug members having base end extremities of a diameter slightly greater than the internal diameter of said tubular structural elements are being adapted to snugly receive an end extremity of tubular structural members applied over said lugs, (g) said connector element having a plurality of connecting lugs arrayed in a plane and extending radially outward from a predetermined axis, (h) a thin-walled tubular hub aligned along said axis generally symmetrically with respect to said plane, (i) a thin-walled flange surrounding said tubular hub in generally concentric relation thereto and arranged generally symmetrically with respect to said plane, (j) a thin-walled web section disposed in said plane and joining said tubular hub and said flange, (k) said lugs being integral with and extending radially from said flange.

16. An improved connector element according to claim 15, further characterized by, (a) said flange being of polygonal configuration and having a number of relatively flat sides equal to the number of lugs, and (b) a lug extending radially from each said relatively flat side.

* * * * *